United States Patent [19]

Begey et al.

[11] 4,013,304

[45] Mar. 22, 1977

[54] SKI-BINDING WITH AN ADJUSTABLE TOE OR HEEL HOLD-DOWN LOOP

[75] Inventors: Jean-Marie Begey, Cluses; Alain Neau, Thyez, both of France

[73] Assignee: Garcia Corporation, Teaneck, N.J.

[22] Filed: Jan. 28, 1976

[21] Appl. No.: 653,259

[30] Foreign Application Priority Data

Mar. 11, 1975 France ..... 75.07585

[52] U.S. Cl. ..... 280/618; 280/623

[51] Int. Cl.[2] ..... A63C 9/00

[58] Field of Search ..... 280/618, 617, 616, 634, 280/633, 636, 620, 619, 613, 612, 611, 615

[56] References Cited

UNITED STATES PATENTS

| | | | |
|---|---|---|---|
| 3,284,092 | 11/1966 | Rumaner | 280/620 |
| 3,649,039 | 3/1972 | Gertsch et al. | 280/620 |
| 3,924,868 | 12/1975 | Koos | 280/634 X |
| 3,936,064 | 12/1976 | D'Alessio et al. | 280/618 |

FOREIGN PATENTS OR APPLICATIONS

| | | | |
|---|---|---|---|
| 17,179 | 8/1904 | Austria | 280/618 |
| 669,114 | 7/1929 | France | 280/615 |
| 75,699 | 7/1950 | Norway | 280/619 |
| 78,143 | 2/1951 | Norway | 280/621 |
| 117,794 | 12/1926 | Switzerland | 280/619 |

*Primary Examiner*—Robert R. Song
*Assistant Examiner*—Milton L. Smith
*Attorney, Agent, or Firm*—Fitzpatrick, Cella, Harper & Scinto

[57] ABSTRACT

A support plate of a ski binding has a rigid boot sole hold-down loop slidably mounted on lateral guide profiles at an end of the support. The rigid loop has a central part which fits over the sole and bent, integral end parts terminating with complementary profiles fitting on the guide profiles of the support. Positioning notches on the support cooperate with notches of an element slidably mounted on the arms of the loop which can be clamped on the support to lock the loop in position. Alternatively, the notches are formed in the complementary guide profiles, and are clamped by a similar element slidably mounted on the loop arms.

13 Claims, 12 Drawing Figures

SKI-BINDING WITH AN ADJUSTABLE TOE OR HEEL HOLD-DOWN LOOP

The invention relates to ski bindings and is particularly concerned with boot sole toe or heel hold-down loop assemblies of the type which are movably mounted along lateral guide profiles extending longitudinally along a support to accomodate for boots of different sizes, in which the support has a series of positioning notches for the assembly.

A known device of this type available on the market has a toe loop assembly with a segment of a flexible metal cable joined at its ends to two independently screw-set adjustable slide pieces slidable along notched rails at the forward end of a support plate. Such a device is advantageous in that it permits an accurate adjustment for boots of greatly varying sizes, but is somewhat inconvenient to set. In effect, since the cable is flexible and the slide pieces are independent of one another, the setting of each slide piece must be made independently, which is time consuming. Moreover, to ensure accuracy of setting, the notches are made small which makes exact transverse alignment of the two slide pieces difficult.

An object of the invention is to simplify a boot-sole toe or heel hold-down assembly of the aforesaid type, both in its construction and in use by enabling setting of the assembly with its clamping means in a selected position in a simple, single operation.

According to the invention such an assembly comprises a rigid loop having a central part shaped to fit over an end part of a boot sole, and two integral end parts bent relative to the central part and terminating with profiles complementary to and fitting against said lateral guide profiles of the support. The assembly has a member provided with notches cooperating with said notches of the support, and means are provided for clamping said notches of the member in engagement with said notches of the support.

In one embodiment of the invention, said notches of the support are disposed transverse to the support in at least one row, and said member is a discrete plate-like element slidably mounted on said end parts of the rigid loop.

In another embodiment of the invention said notches are formed in said lateral guide profiles of the support and in said complementary profiles in said end parts of the rigid loop.

Embodiments of the invention are shown, by way of example, in the accompanying drawings, in which.

Figure 1:
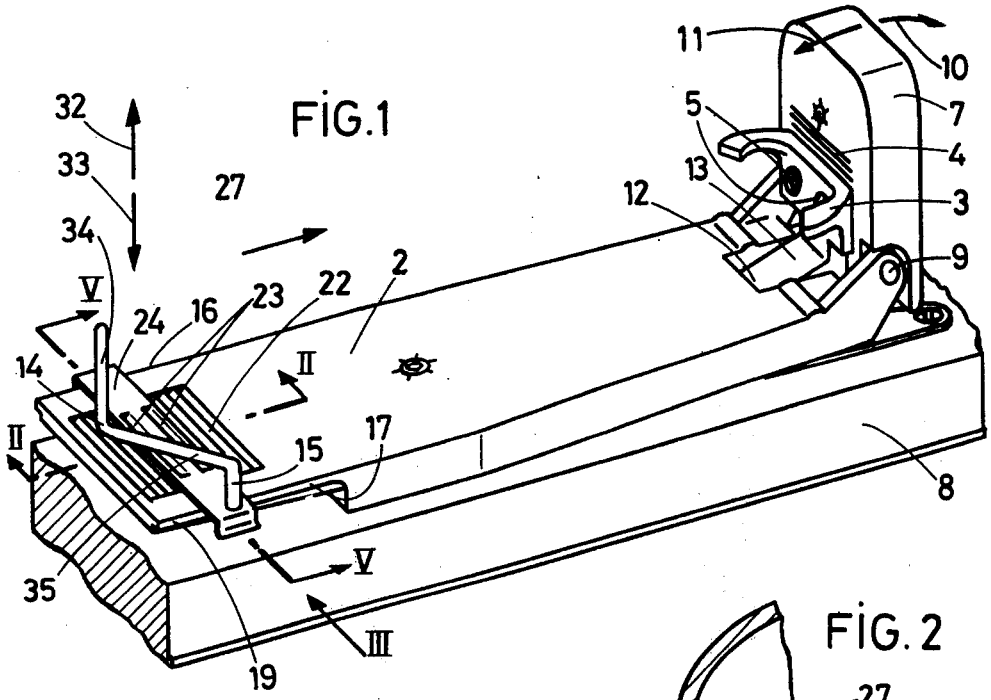
FIG. 1 is a perspective view of a first embodiment of the invention.

The device shown in FIGS. 1 to 5, comprises means for retaining a boot sole 1 on a support forming part of a ski binding, for example a sole plate 2 of a safety ski binding. One end, for example the rear end, of sole 1 is held on plate 2 by a jaw 3 (FIG. 1) which can be adjusted in height along a row of notches 4 and held at a chosen height by a screw 5. Jaw 3 is held by a carrier 7, containing a rear mechanism for locking the binding plate 2 on ski 8, and pivotable about pins 9 in directions 10 and 11 to respectively free sole 1 from plate 2, or hold it on the plate. The holding position is maintained by means of a locking device, not shown, which acts on the end of a fitting treadle 13 of jaw carrier 7 in a manner to positively secure the boot, not shown in FIG. 1.

Figure 2:
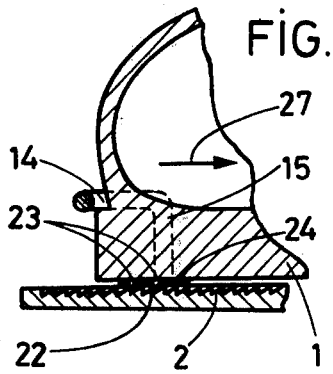
FIG. 2 is a partial cross-section along line II—II of FIG. 1, showing part of a secured boot.

The device for securing the other end of the sole 1, i.e. the front end in this example, includes retaining means in the form of a rigid loop 14 shaped to fit about the protruding front end of sole 1. The rigid loop 14 has at each end an integral extension or arm 15 bent down to face one of the lateral edges 16 or 17 of plate 2. Each arm 15 has at its end an inwardly-directed profile 18 (FIG. 5) cooperating with a complementary guide profile 19 extending longitudinally along the edge 16 or 17. On its upper face, plate 2 has, as shown in FIG. 2. a row of transverse notches 22 which cooperate with complementary notches 23 provided on a single plate-like clamping element 24 having openings 25 and 26 by which it is slidably mounted on the two arms 15. As shown in FIG. 2, the notches 22, 23 are for example formed with an inclination facilitating movement of element 24 in only one direction 27, generally towards the location of a secured boot 1. The transverse notches 22 of plate 2 and 23 of element 24 could be arranged in several rows parallel to the longitudinal axis of plate 2.

To hold the notches 22, 23 in engagement clamping means are provided in the form of two resilient, bent lugs 28 (FIG. 5) at the ends of element 24 which bear on the lower ends of arms 15 and, generally speaking, under the plate 2 to clip the element 24 down on plate 2.

Figure 3:
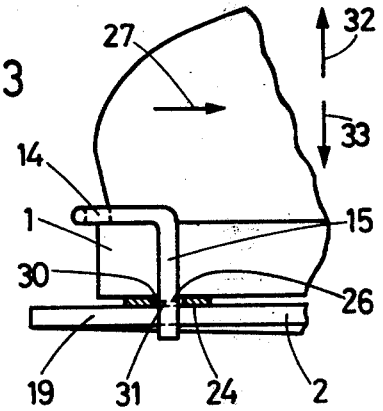
FIGS. 3 and 4 are partial side elevational views looking along arrow III of FIG. 1, showing different positions of the rigid loop as a function of different boot-sole thicknesses.
Figure 4:
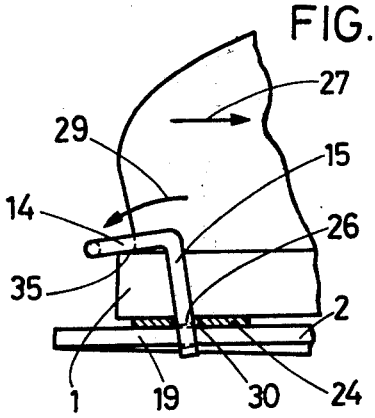

Advantageously, but not necessarily, play can be left to allow the rigid loop 14 to adopt an inclination as indicated by 29 (FIG. 4). A first play 30 is allowed (longitudinally of plate 2) between arms 15 and the corresponding orifices 25 and 26 of element 24, and a second play 31 is allowed between the profile 18 of each arm 15 and the cooperating profile 19 transverse of guide profile 19 and plate 2, along 32, 33 (see FIGS. 1, 3 and 5).

To adjust the position of the rigid loop 14, the boot is placed on plate 2, with the rear of the sole under jaw 3, and the loop 14 with element 24 is then moved in direction 27 along guide profiles 19. This movement is made possible by the elasticity of lugs 28 whereby element 24 is able to move up slightly (as per 32), with its notches 23 sliding over the inclines of notches 22 of plate 2. As the notches 22 and 23 are only inclined in one direction, the loop 14 cannot unwantedly move in the other direction while the element 24 is clipped down. If the arms 15 are only slightly longer than the thickness of sole 1, the stirrup 14 is positioned as shown in FIG. 3 with its arms 15 approximately vertical and the entire major central part of loop 14 bearing against the upper face of the front of the sole. If, however, the arms 15 are longer than the thickness of sole 1, the loop 14 is positioned as shown in FIG. 4, in which arms 15 are forwardly inclined as per 29, and with loop 14 bearing by two points 34 and 35 (FIGS. 1 and 4) against the upper edge of sole 1. These two bearing points ensure firm holding of the sole during skiing.

The rigid loop 14 could have a different shape from that shown in FIG. 1. For example, instead of having a central part of flattened V-shape, it could be curved substantially following the shape of the toe end of a boot. In the case of FIG. 4, the loop would thus bear by its median part on the sole. Likewise, the play provided at 30 and 31 could be eliminated, so that the loop 14 will always remain in the upright position of FIG. 3, the arms 15 being chosen with a length corresponding to the boot sole in question. This possibility is particularly interesting in case of the normalization of ski boot sole thickness.

Figure 5:
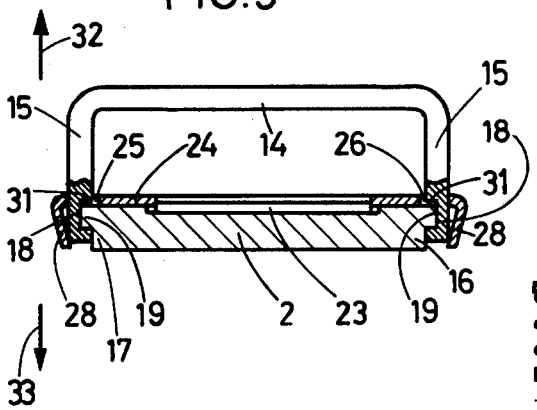
FIG. 5 is a cross-section along line V—V of FIG. 1.

The guide profiles 19 shown on FIG. 5 with a rectangular section could have other sectional shapes, such as rounded, or inclined to the upper face of plate 2. In any case, the corresponding profiles 18 of arms 15 would have a complementary shape. Likewise, profiles 19 could be hollow instead of in relief, and the complementary profiles 18 in relief instead of being hollow.

Figure 6:
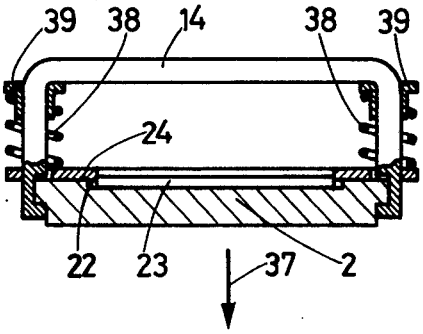
FIGS. 6 to 9 are views similar to FIG. 5 showing four varied forms of clamping means.
Figure 7:
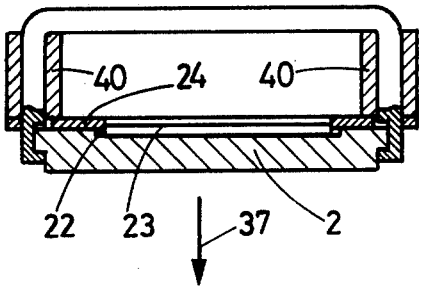

FIGS. 6 and 7 show variations of the means for clamping the notches 23 of element 24 in notches 22 of plate 2. In these variations, the resilient lugs 28 are replaced by elastically deformable pieces threaded on arms 15 to constantly bias the element 24 in direction 37 against plate 2. Notches 22 and 23 are thus constantly held in engagement. In FIG. 6, compression coil springs 38 act against sleeves 39 threaded on arms 15 and which are stopped by the central part of loop 14. In FIG. 7, the springs 38 and sleeves 39 are replaced by tubular pieces of an elastomer bearing directly against the central part of loop 14.

The previously-described clamping means (FIGS. 5, 6 and 7) all involve resilient biasing means and it is preferable, but not essential, that the notches should be inclined in one direction, to permit movement of the loop only in direction 27, without having to unclamp the element 24.

Figure 8:
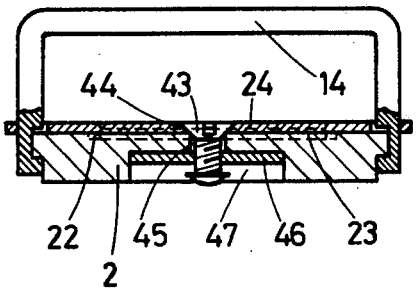
Figure 9:
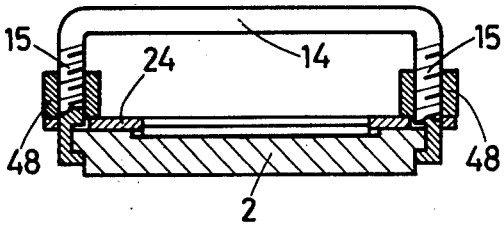

FIGS. 8 and 9 show two variations of the clamping means with which the notches can have any shape, for example inclined in either direction, inclined in both directions, or not inclined at all (for example, with a rectangular section). In one particular form, two parallel rows of notches are disposed on the element 24 and plate 2, with the rows of notches inclined in opposite directions to prevent movement of element 24 in the two directions, while it remains clamped. Such forms of notches are notably possible when the clamping means is positive, rather than elastic.

In the variation of FIG. 8, the means for clamping element 24 are formed by a screw 43 passing through a central hole 44 of element 24 and in a longitudinal notch in plate 2. The screw 43 has a bevelled head embedded in element 24 and its shank engages in a nut 46 held against rotation in a recess under plate 2. A reverse arrangement is also possible, with the nut lodged in a recess in element 24 and the screw head bearing under plate 2. To move the element 24 and yoke 14 along direction 27 (FIG. 1) it suffices to slightly loosen screw 43 to allow disengagement of notches 23 and 22, then to tighten screw 43 when the loop 14 is correctly positioned. Tightening is carried out after the boot sole has been removed.

FIG. 9 shows a variation in which the clamping means are formed by nuts 48 advantageously knurled on their outer faces and each screwed on a threaded arm 15 of rigid loop 14 to clamp element 24 on plate 2. Adjustment is carried out by momentaneously unscrewing nuts 48 to move then away from element 2.

Figure 10:
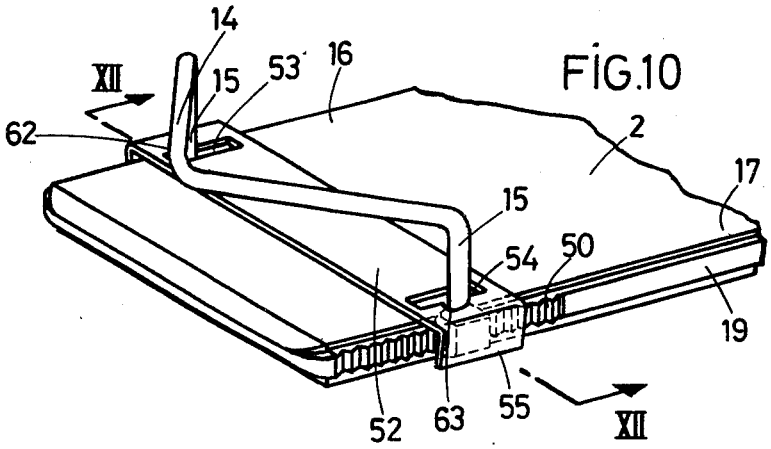
FIG. 10 is a perspective view of a second embodiment of the invention.
Figure 11:
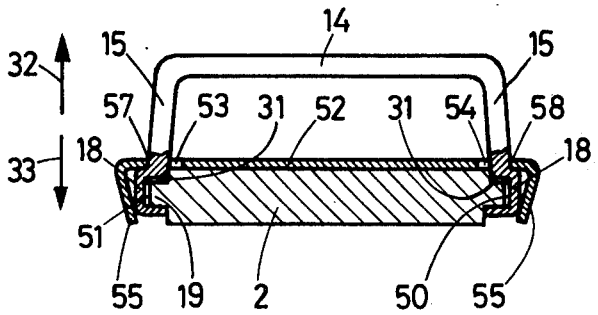
FIGS. 11 and 12 are cross-sections along line XII—XII of FIG. 10, with the device respectively in a clamped and an unclamped postition.
Figure 12:
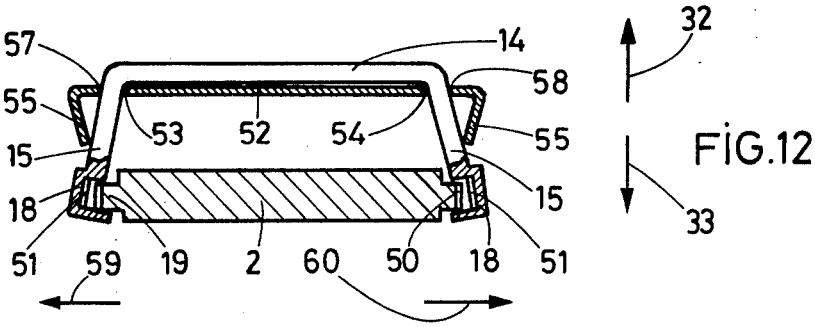

FIGS. 10 to 12 show a second embodiment in which the sole-plate 2 has notches 50 disposed, not on its upper face, but externally on its lateral edges 16 and 17. In the example shown, notches 50 are provided in the parts forming guide profiles 19. Notches 50 cooperate with complementary notches 51 in the profile 18 of each arm 15. The arms 15 are inclined, and diverge out from the central part of rigid loop 14 as the non-parallel sides of a trapezoid.

The means for clamping the notches 50 in engagement with notches 51 are formed by a single plate-like clamping element 52 having openings 53, 54 slidably mounting it on arms 15 between two positions. In the first position, shown on FIG. 11, the clamping element 52 is held against plate 2 by two bent lugs 55 at the ends of element 52 which elastically clip under the ends of arms 15. In this position, the arms 15 are elastically deformed towards one another, while still remaining divergent from another, by engagement in external parts 57, 58 of the openings 53, 54 of element 52. The notches 51 are hence held in engagement with the notches 50 of support 2. In the second position, shown in FIG. 12, the clamping element 52 is spaced apart from plate 2, the external parts 57 and 58 of the openings 53, 54 of element 52 having allowed relaxation of the arms 15 as per 59 and 60. The arms 15 thus spring apart elastically and disengage notches 51 from notches 50.

Advantageously, but not necessarily, play is provided to enable the rigid loop 14 to adopt an inclined position similar to that shown in FIG. 4. A first play is provided along the longitudinal direction of plate 2 at 62 and 63 between the arms 15 and the corresponding openings 53 and 54 of element 52. A second play 31 is provided between the profile 18 of each arm 15 and the guide profile 19 with which it cooperates, this play being vertical and transverse to guide profile 19 and plate 2. A further play is provided along the direction of guide profile 19 between notches 50 and 51 when the various elements are clamped in the position of FIG. 11.

To adjust the position of stirrup 14, the clamping element 52 is lifted up in direction 32 by outwardly bending the lugs 55 to bring the various elements to the position of FIG. 12. The loop 14 is then moved with element 24 along guide profiles 19 and, when it is correctly positioned, the clamping element 24 is pushed down according to 33 to bring the element to the position of FIG. 11.

The remarks previously made in connection with the first embodiment, concerning the various possible shaped of the rigid loop 14, the possibility of preventing inclination of the loop 14 when a boot is fitted by eliminating the play, and the different possible shapes of guide profile 19, also apply to the second embodiment.

It is observed that in all of the described embodiments, adjustment of the position of the rigid loop is simple and rapid, the positioning being made simultaneously along the lateral edges of the sole plate.

The invention is particularly useful for safety ski bindings of the type having a sole plate which is secured under a boot sole during skiing.

What is claimed is:

1. In a ski binding comprising a support and a boot-sole hold down loop assembly movably mounted along lateral guide profiles extending longitudinally along the support to accommodate for boots of different sizes and in which the support has a series of positioning notches for said assembly, the improvement wherein said assembly comprises a rigid loop having a central part shaped to fit over an end part of a boot sole and two integral end parts bent relative to the central part and terminating with profiles complementary to and fitting against said lateral guide profiles of the support, and a single clamping member movably mounted on the end parts of the loop and provided with means for clamping the loop to the support, one of said loop and said clamping member being provided with notches cooperating with said notches of the support to position the loop at a desired location.

2. A ski binding according to claim 1, in which said central part of said rigid loop is of flattened V-shape, said end parts extending approximately perpendicularly to the plane of said V.

3. A ski binding according to claim 1, in which said notches of the support are disposed transverse to the support in at least one row, and said single clamping member is a discrete plate-like element slidably mounted on said end parts of the rigid loop and provided with said cooperating notches.

4. A ski binding according to claim 3, in which said notches of the support and of said plate-like element are shaped to facilitate movement of said plate-like element and of said loop on said support in one given direction generally towards the location where a boot may be held by the binding.

5. A ski binding according to claim 3, comprising at least two parallel rows of notches on said support and on said plate-like element, in which the notches of different rows are inclined in opposite directions to prevent movement of said plate-like element and of said loop on said support in either direction when said notches are clamped in engagement.

6. A ski binding according to claim 3, in which said clamping means are formed by resilient downwardly-bent end portions of said plate-like element which clip said element down onto said support.

7. A ski binding according to claim 3, in which said clamping means are formed by compression coil springs disposed on said end parts of the rigid loop to bias said plate-like element against said support.

8. A ski binding according to claim 3, in which said clamping means are formed by pieces of elastomer disposed on said end parts of the loop to bias said plate-like element against said support.

9. A ski binding according to claim 3, in which said clamping means are formed by a screw passing through said plate-like element and a longitudinal slot in said support, and a nut held against rotation relative to said element and said support.

10. A ski binding according to claim 3, in which said clamping means are formed by nuts screwed on threads provided on said end parts of the rigid loop, said nuts cooperating with said plate-like element to hold it down on said support.

11. A ski binding according to claim 1, said notches being formed in said lateral guide profiles of the support and in said complementary profiles in said end parts of the rigid loop, the rigid loop being resilient and said end parts diverging outwardly from said central part, and said clamping member being formed by a plate-like element having openings therein by which it is slidably mounted on said end parts of the rigid loop between two positions, a first position disposed on said support and inwardly holding said end parts to engage the notches therein with those of the support, and a second position removed from said support and allowing said end parts of the loop to move out to disengage said notches, said plate-like element having resilient bent end portions for clipping it on said support in said first position.

12. A ski binding according to claim 3, comprising means defining a play in the mounting of said rigid loop relative to said plate-like element and said support to permit tilting of said loop.

13. A ski binding according to claim 11, comprising means defining a play in the mounting of said rigid loop relative to said plate-like element and said support to permit tilting of said loop.

* * * * *